United States Patent [19]

Schmall et al.

[11] 4,215,856

[45] Aug. 5, 1980

[54] APPARATUS AND METHOD FOR CONTROLLING GAME PLAYING TIME

[75] Inventors: Karl-Heinz Schmall, Moncalierstrasse 5, D-757 Baden-Baden, Fed. Rep. of Germany; Piotr Sendor, Frankfurt am Main, Fed. Rep. of Germany

[73] Assignee: Karl-Heinz Schmall, Baden-Baden, Fed. Rep. of Germany

[21] Appl. No.: 896,377

[22] Filed: Apr. 14, 1978

[30] Foreign Application Priority Data

Apr. 15, 1977 [DE] Fed. Rep. of Germany ..... 2716717
Apr. 30, 1977 [DE] Fed. Rep. of Germany ..... 2719354

[51] Int. Cl.[2] ..... A63B 71/00
[52] U.S. Cl. ..... 272/3; 273/55 R; 273/1.5 R
[58] Field of Search ..... 273/1 E, 1 ES, 1.5 R, 273/25, 55 R; 272/3, 4, 100, 105; 46/234, 254, 255

[56] References Cited

U.S. PATENT DOCUMENTS 3,508,034 4/1970 Masatoshi et al. ..... 272/4
3,946,314 3/1976 Oswald ..... 272/4

*Primary Examiner*—Richard C. Pinkham
*Assistant Examiner*—T. Brown
*Attorney, Agent, or Firm*—Larson, Taylor and Hinds

[57] ABSTRACT

Interruptions in the playing time of a game having a set playing time are recorded by the transmission of signals by the referee at the beginning and end of each interruption. The referee's signals are transmitted by wireless to a reception conductor located in or on the playing area and conducted therefrom to recording and display devices. To prevent interference by signals other than those from the referee, interference receiving conductors are located outside the playing area and/or around the spectator areas and signals received by these loops are suppressed by comparison with the signals emitted within the playing area. Interference may be further prevented by providing for the referee to transmit two separate signals the characteristics of which are compared with those of predetermined signals and elapsed time only recorded when the signal characteristics coincide.

12 Claims, 7 Drawing Figures

APPARATUS AND METHOD FOR CONTROLLING GAME PLAYING TIME

BACKGROUND OF THE INVENTION

The invention relates to an arrangement for determining the effective playing time of a sporting team game, having a referee and a predetermined duration of play, in which interruptions of play are signalled acoustically by the referee and comprising at least one time measuring device which comprises an actuator input for the interruption and re-starting of the measurement, a receiver device for wireless signal transmission of which the output is connected to the actuator input, a portable transmitter device for the referee to give signals to the receiver device, and a switch device operable by the referee for the activation of the transmitter device and for the transmission of signals which interrupt and restart the time measurement at the beginning and end respectively of each interruption of play.

In practice it has proved desirable to provide special measures for increasing the security of such arrangements against interference, to render impossible interference by interfering transmitters with the control of the time measurement. Moreover the signal transmission should be simplified. An object of the invention is to provide improved means for this purpose.

SUMMARY OF THE INVENTION

In accordance with the present invention, the receiver device comprises at least one playing area reception conductor laid on or in the playing area for the reception of the signals radiated by the transmitter device. This measure achieves the object in that the signal transmission can be tuned more specifically to the transmitter device of the referee, and that interfering influences and signals arriving at a lower level can be suppressed by predetermining specific threshold values. This suppression of interference can be achieved especially advantageously if the playing area reception conductor is a loop tuned to the transmission and reception frequency, in which signals are induced by the portable transmitter device. If this loop is laid around the playing area, signals given by the referee will obviously be received preferentially, since the referee is situated on the playing area and thus within the loop or coil. A coil-type arrangement consisting of several "windings" is here to be understood as a loop. Signals emitted outside the playing area, even at great emission power, are received only weakly in a loop of such formation and therefore can be relatively simply identified and suppressed.

The suppression of the interfering signals can be ensured further in a simple manner by providing, in addition to the playing area reception conductor, at least one interference signal reception device at the edge of the playing area or around the playing area for the preferred reception of interference signals.

The preferred arrangement for the reception of interference signals can be achieved by known electronic measures, as for example by directional reception arrangements. Reflector arrangements or the like are also possible. By the preferred, and thus amplitude-reinforced, reception of interference signals in the interference signal reception apparatus, it is possible by comparison with the signals received from the playing area reception conductor to determine which signals are "useful signals" given by the referee and which signals are to be suppressed as interference signals emitted outside the playing area.

The interference signal reception can be achieved especially simply if the interference signal reception device comprises at least one reception conductor or reception loop placed around the playing area and/or around the spectator stands and seats. In this reception loop, interference signals emitted for example from the spectator stands are received more strongly because of the closer arrangement outside the playing area than the same interference signals are received by the reception conductor or reception loops in the playing area. Especially in the case of arrangement of closed loops, a difference in the powers of the arriving signals results which can be utilised satisfactorily and in interference-proof manner, so that after appropriate comparison the interference signals are separable from the useful signals.

In order to avoid the signals emitted by the referee being received at different positions of the playing area at excessively different levels and in order to prevent the occurrence of compensation of the signals, for example in the case of the portable transmitter device being placed exactly above one conductor of the loop, the receiver conductors may be laid as concentric loops in the playing area and de-coupled on the output side through separate amplifiers.

It has proved especially valuable if, for comparison or for suppression of interference signals, the individual reception loops are connected through amplifiers and rectifier arrangements to the inputs of a summing amplifier, the rectifier arrangements for the playing area amplifier devices possessing such reverse polarity, in comparison with the rectifier arrangement for the interference signal amplifiers, that the signals of the interference signal reception loop are negative-feedback-coupled to the interference signal proportion of the playing area reception conductor.

The tuning of the reception loops by parallel or series-connected capacitors here results in additional interference-proofing, since interfering transmitters with different frequencies are, in this way, already suppressed on reception.

In addition to the reception loops, transmission conductors can also advantageously be laid in the playing area, by means of which signals can be given to the referee. Of course the reception conductors can also be used for this purpose.

Further improved security against interference can be obtained simply and without great technical expense if the portable transmitter device for wireless signal transmission delivers in each case at least two different signals and in the receiver device at least one comparator arrangement is provided for ascertaining the respective signal variation and/or the simultaneous arrival of the said signals. In signalling by the referee, it can be provided that either the two signals are emitted simultaneously or for example one signal is interrupted when the other commences, etc. It is also conceivable to use only the signal variations by integration of the signals and compare them with predetermined ideal values. The reception device can then ascertain whether the two different signals are emitted in the prescribed timing in relation to one another, and if for example only one signal is emitted or a signal is emitted too late, the evaluation of the signals can be omitted.

By way of example, it is conceivable to actuate an electromagnetic transmitter simultaneously with the acoustic signal by the whistle and to provide in the reception device an acoustic and an electromagnetic receiver, the outputs of which are then compared for coincidence and to deliver effective signals for the actuation of the time-measuring device only if both signals in fact occur simultaneously. If therefore, for example in a football game, an interference with the time measurement should be brought about intentionally by the use of an identical whistle by a spectator, only the acoustic receiver will receive the signal of the whistle. Since however the simultaneous actuation of the electromagnetic transmitter device does not take place, this does not lead to the intended interference. In this way it is possible to exclude even attempts at interference by identical signal emitters. The invention can here of course also be realised by the use of several acoustic signal emitters within and outside the audible range.

The technical progress and inventive content of the object of the application are guaranteed as may be seen both by the new individual features and also by combination and sub-combination of the utilised features.

BRIEF DESCRIPTION OF THE DRAWINGS

As shown in FIG. 1 the diagrammatically indicated whistle 1 of a referee is connected through a thin pipe 2 with a compressed air switch 3 in such a way that the switch 3 is closed on actuation of the whistle 1. The compressed air switch 3 can be contained together with a transmitter device 4 in one of the referee's pockets, the thin pipe 2 being provided directly for holding the whistle 1 in place of a cord. Other arrangements can be provided for switch actuation using for example mechanical, electromagnetic or capacitive transmission devices. The actuation of the compressed air switch 3 effects activation of a transmitter device 4 the signals of which are transmitted in known manner to an associated reception device 5.

Figure 1:
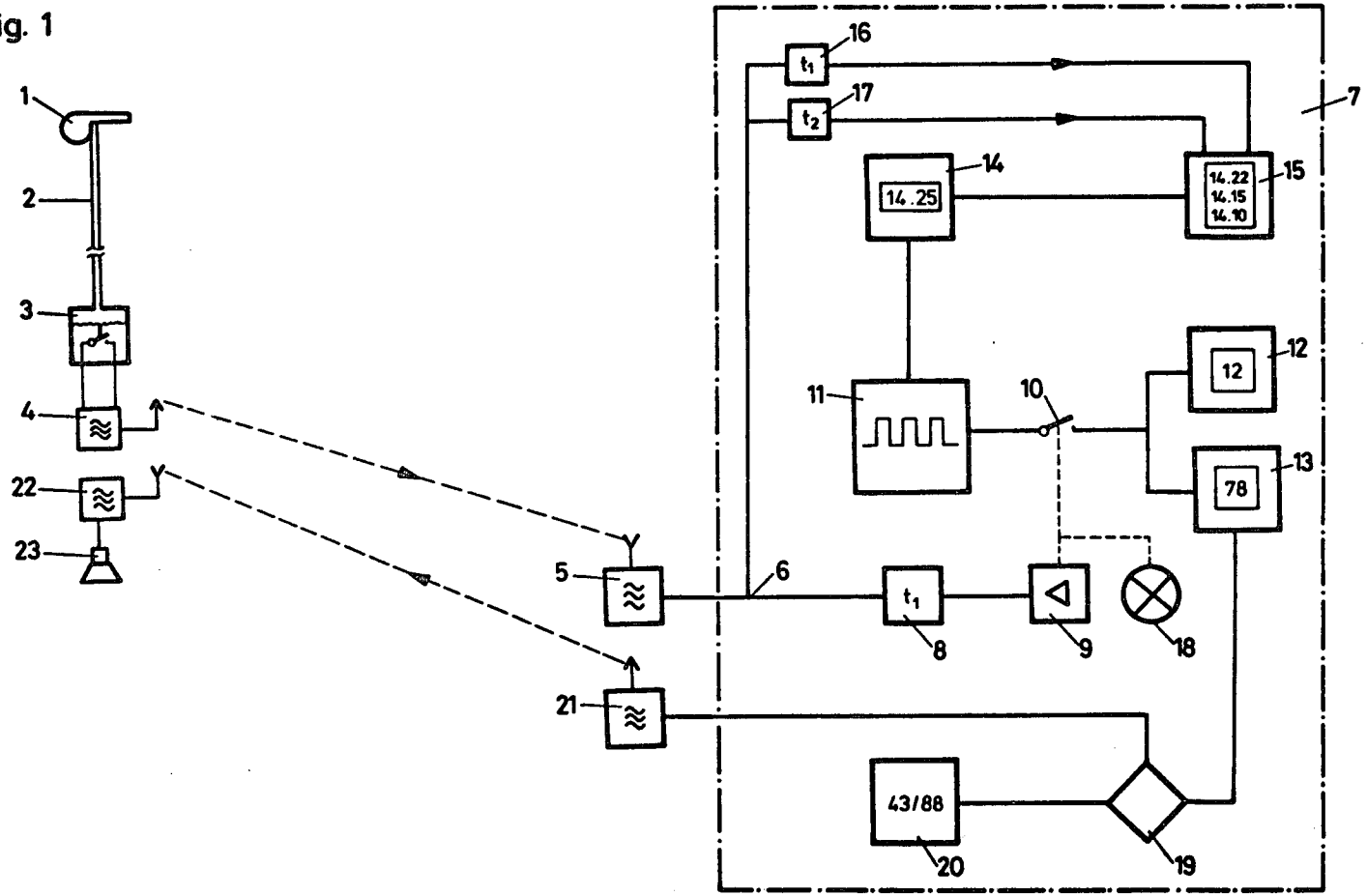
FIG. 1 shows a diagrammatic arrangement for the determining of the effective playing time.

The output of the receiver device 5 is connected to the actuation input 6 of a time-measuring device 7 and is connected through a time member 8 to an amplifier 9. As soon as a signal is emitted, in the course of play, by the transmitter device 4 on appropriate actuation of the whistle 1, which signal is longer than a time for example 1.5 seconds, predetermined by the time member 8, the signals received and amplified by the receiver 5 are transmitted by the time member 8 to the amplifier 9 which on its output side actuates a switch 10. The switch 10 is connected to an output of a timer 11 and connects the latter with a first clock 12 for the measurement of the playing time consumed, for example, 12 minutes, and with a second clock 13 which indicates the remaining playing time for example 78 minutes. The timer 11 is also connected through a second output with a standard clock 14 which indicates the actual time of day and delivers a time code to a recording device 15. The recording device 15 is also connected through two time members 16 and 17 with different time constants $t_1$ and $t_2$ to the receiver device 5.

Every time the receiver device 5 receives a signal from the transmitter device 4, the recording device 15 is actuated, different codings being effected on the recording strip according to whether the signal corresponds to the time constant $t_1$ or $t_2$, so that, as well as a characterisation of the interruption of play, other signals from the referee can be recorded and coded. At every recording, the recording device 15 records the time of the standard clock 14, so that the entire course of play can be subsequently monitored. At the same time, as may be seen, a signal corresponding to the time constant $t_1$ leads to an interruption of the connection between the time member 11 and the clocks 12 and 13, so that the latter are stopped. Moreover, the amplifier 9 actuates a lamp 18 which indicates the interruption of play in optically clearly visible manner. As soon as the transmitter device 4 again delivers a signal to the reception device 5 on continuation of play by a renewed whistle, the amplifier 9 is switched over again and the switch device 10 is re-activated in such a manner that the time member 11 again supplies the two clocks 12 and 13 with timing pulses and thus immediately continues the time measurement. Moreover, the lamp 18 is switched off. The indicating figures of the two clocks 12 and 13 are made so large that a clear observation of the time lapse is possible for the spectators and also for any television cameras.

In addition to the time-measuring device 7 in the example of this embodiment a transmission of signals back to the referee is also provided.

These are intended especially to draw the attention of the referee to the elapse of playing time to half time and to the end of the game. For this purpose there is connected to the second clock 13 one input of a comparator device 19 the other input of which is connected to a setting means 20. As soon as the clock 13 gives a signal corresponding to the value preset to the comparator device 19 after the elapse of for example 43 and 88 minutes, a control signal is delivered to a stationary transmitter device 21 which then activates a receiver device 22 which can be carried by the referee, and which in turn actuates a small buzzer 23. Thus, the attention of the referee is automatically drawn say two minutes before the elapse of each playing period to the approach of the end of play, and the referee can arrange himself accordingly. It is also possible to transmit short notes at seconds, for example 5 seconds before the end of play. Of course the use of the stationary transmitter device 21 and of the receiver device 22 is not obligatory and instead another indicator device can be provided, for example in the form of a flashing lamp or self-flashing time-indication numerals, which signals the approaching end of playing time quite generally in the stadium.

In accordance with the invention it can further be provided that when the intended playing time is reached and the final whistle does not sound—in this case the referee permits further play according to his own discretion—the clock runs forward again and the preferably digital, electronically operated clock mechanism immediately counts forward, while the indication remains held at zero for a few seconds. If the final whistle of the game takes place during this tolerance time, the clock is finally set to zero. After the elapse of the tolerance time however it continues to run until it is halted by a whistle and then shows the "extra time". At the same time a corresponding signal is given which marks this indicated time as "extra playing time".

Obviously the invention can be adapted in versatile manner to the different requirements of different games, and known and proven components and transmissions devices can be used so that it is not necessary to discuss their technical data further here.

Moreover, the activation of the transmitter device by the referee can also be carried out in a different manner (for example by a hand switch), although "automatic" actuation on whistle operation possesses essential advantages and more especially precludes memory lapses by the referee.

Figure 2:
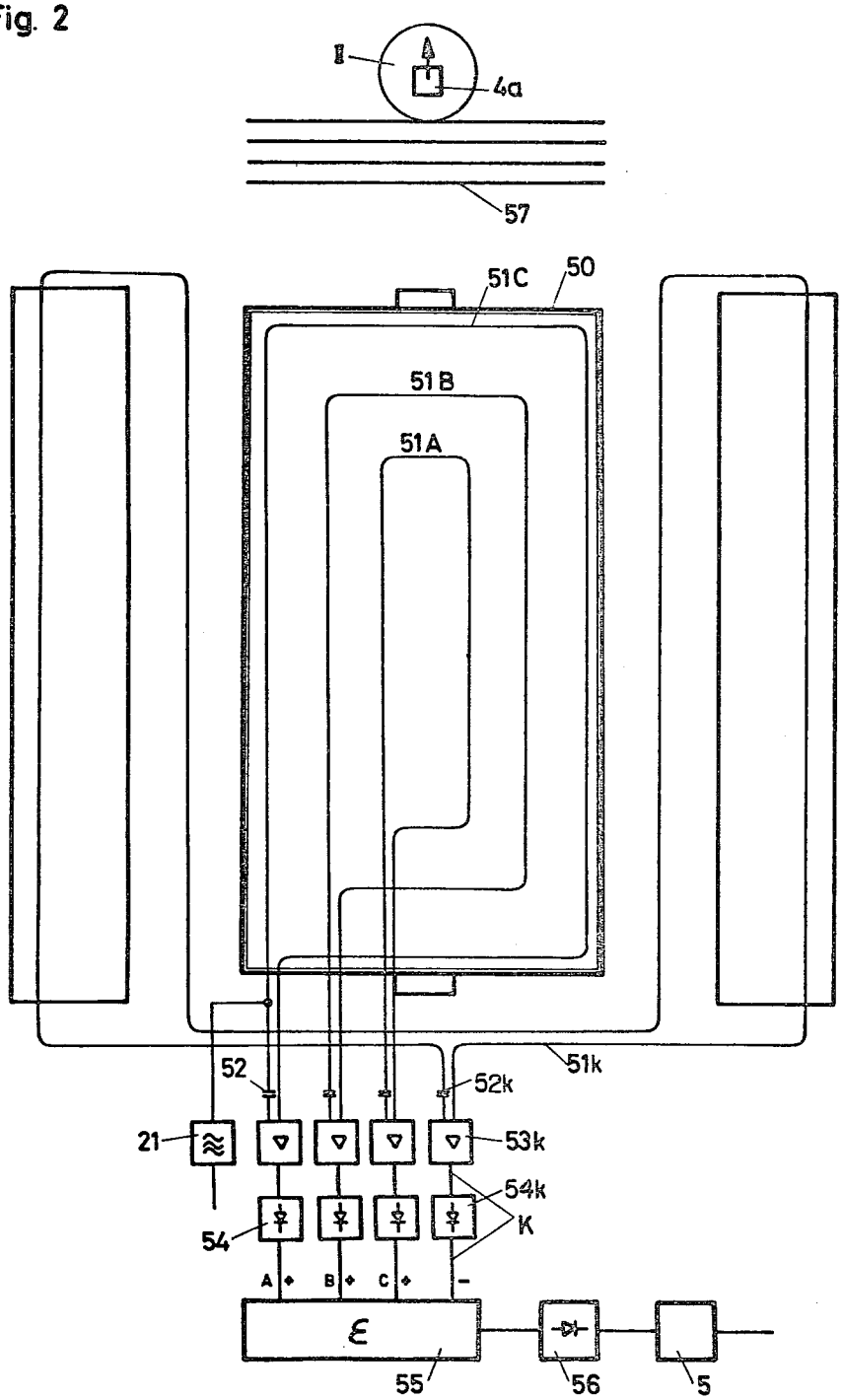
FIG. 2 shows the arrangement of the reception loops in the playing area in diagrammatic representation.

FIG. 2 shows diagrammatically the arrangement of the reception loops on a football playing area, represented symbolically by a limiting line 50. For the reception of the electromagnetic waves emitted by the transmitter device 4 a number of reception loops (three as shown) 51*a*, 51*b* and 51*c* are laid in the playing area beneath the turf. The reception loops 51 as shown consist each of only one individual laid-out reception lead, but of course coil-type multiple loops may also be used. Measurements have shown that the inductance of the reception loops 51 amounts to about 1 mH, which has proved sufficient. For the tuning of the reception loops 51 capacitors 52 are provided which render possible a tuning to the frequency of the transmitter device 4 of 9 kHz. As illustrated, the reception loops 51 are each connected separately to amplifiers 53 so that the individual loops 51 are de-coupled from one another. The amplifiers 53 are connected on the output side to rectifier arrangements 54 which are connected with the inputs of a summing amplifier 55. An interference reception loop 51*k* is laid at a distance around the playing area, this likewise being tuned by a capacitor 52*k* and fed to an amplifier 53*k*.

On the output side the amplifier 53*k* is connected to a rectifier arrangement 54*k* which is of reverse polarity compared with the rectifier arrangements 54. Accordingly the rectifier arrangements 54 apply positive signals to the inputs of the summing amplifier 55 while the rectifier arrangement 54*k* delivers negative signals to the associated input of the summing amplifier 55.

Figure 3:
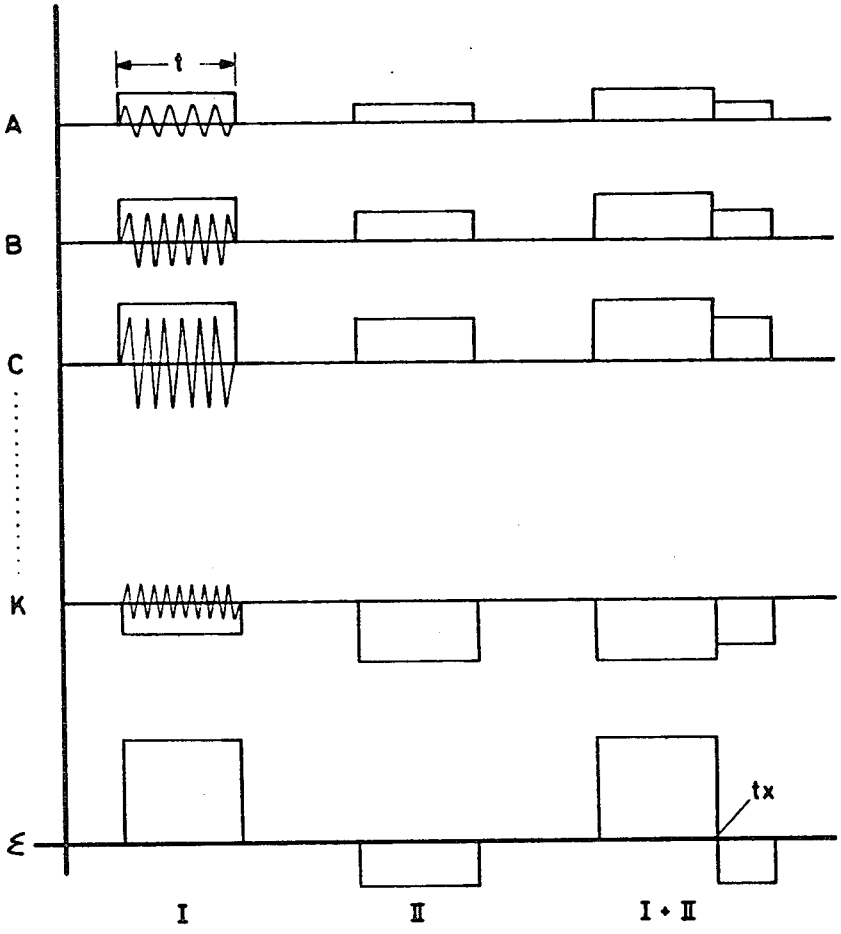
FIG. 3 shows a typical signal course in the reception device for useful and interference signals.

If the signals of the portable transmitter device 4, designated by I in FIG. 2 and FIG. 3, are emitted within the reception loops 51*c* but outside the reception loops 51*a* and 51*b*, the signals C (FIG. 3) are greater in amplitude than the signals A and B. In FIG. 3 it is indicated symbolically that the signals transmitted during a time duration t are high-frequency signals which however, after amplification and rectification in the rectifier arrangements 54, are present as rectified signals of pulse form. The signal K received in the interference signal reception loop 51*k* is likewise smaller in amplitude than the signal C or the signal B by reason of the distance from the location of the transmitter device 4. On totalling of the individual signals in the summing amplifier 55 a positive signal occurs which is composed of the sum of the individual signals and is somewhat smaller than the sum of the signals A, B and C by reason of the negative influence of the signal K.

This positive signal is fed through a rectifier arrangement 56 to the reception device 5 and processed further by the latter in an arrangement corresponding to the arrangement according to FIG. 1.

If however signals II (FIG. 3) are emitted by an interfering transmitter 4*a*, situated on the diagrammatically indicated stand 57, the interference signal reception loop 51*k* is charged with substantially stronger signals than the playing area reception loops 51*a*, 51*b* and 51*c*.

The interference signal K in this situation II possesses greater amplitude than the signals A to C, so that the negative input voltage predominates on the summing amplifier 55 and thus also on its output. However, this negative signal is blocked by the rectifier arrangement 56, so that there is no influence on the reception device 5 and thus on the time-measuring arrangement by the interference signal K.

The last pulse diagram in FIG. 3 shows the case of simultaneous emission of a referee signal (I) and an interfering signal (II). Provided that the two signals have the same frequency, a superimposition of the signals takes place in all the reception loops 51*a*, 51*b*, 51*c* and 51*k*. This signifies that the interference signal not only effects an increase of the amplitude of the output signal in the interference signal reception loop 51*k* but also increase the output signals of the playing area reception loops 51*a*, 51*b* and 51*c*. This is valid because the interference transmitter device 4*a*, because of its greater distance and the fact that it is situated outside the playing area and thus outside the reception loops 51, must operate with a very high transmission power in order to induce any power into the reception loops 51. Thus in the case of the simultaneous occurrence of interference pulses and referee pulses, nevertheless the positive voltage values derived from the playing area reception loops 51*a*, 51*b* and 51*c* predominate on the summing amplifier 55, so that despite the presence of an interference signal the time measuring arrangement can be satisfactorily actuated by the transmitter device 4 by way of the rectifier arrangement 56 and the reception device 5. If at the moment $t_x$ according to FIG. 3 the transmitter device 4 is switched off by the referee, the transmission energy arriving in the reception loops 51 is reduced to the value emitted by the interfering transmitter device 4*a* according to situation II, so that at the same moment the negative pulse emitted by the rectifier arrangement 54*k* predominates and thus a negative signal is given by the summing amplifier 55 to the rectifier arrangement 56, which signal is blocked there. Thus due to the selected arrangement interference signals from outside the playing area can be blocked in the simplest way without the possibility of bridging over this blocking by especially high interference transmission powers. It is of course possible to effect the summing both in direct current voltage and in high-frequency, or to carry out the comparison otherwise.

From FIG. 2 it can also be seen that the reception loops can be used for the interference-free transmission of signals to the referee. As described above in connection with FIG. 1, a transmitter device 21 can be provided which transmits signals to a portable reception device 22. In the embodiment according to FIG. 2 the reception loop 51*c* is used for this purpose, which is readily possible in the case of appropriate de-coupling of the transmitter device 21 and contributes to interference-free signal transmission. A different frequency is used for the transmission direction to the referee from that in the direction from the referee to the clock control.

For adaptation to special requirements, the invention can of course be modified without departing from the fundamental idea. By way of example, it is readily conceivable in place of the actuation of the compressed air switch 3 by the whistle 1 to provide a different type of actuation (for example microphone, inductive or capacitive signal transmission) for the transmitter device 4.

Figure 4:
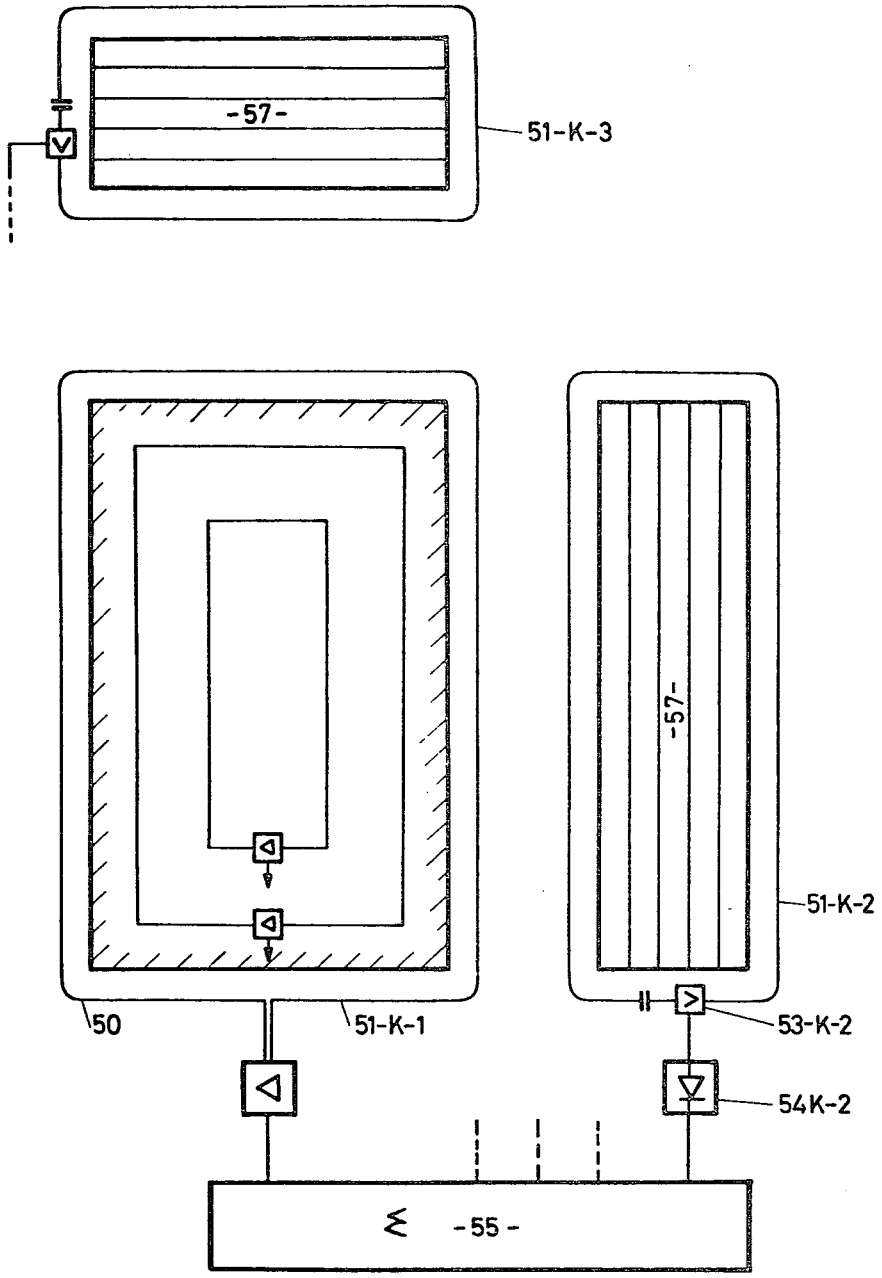
FIG. 4 is a diagrammatic representation of the arrangement of reception conductors.

FIG. 4 shows a modified example of embodiment in which on the one hand the playing area 5 is surrounded by a compensation loop 51*k*-1 and on the other hand the stands 57 themselves are surrounded by compensation loops 51*k*-2 and 51*k*-3.

This renders possible extremely good reception of interference signals, since interfering amplifiers situated within the loops are received with very high amplitude. Moreover, a simple comparison of the amplitude of the signals received from the individual loops 51*k*-2 and 51*k*-3 permits of locating in which of the loops, and thus on which of the stands, an interfering transmitter may be situated. It is also possible to obtain more exact location by further division of the loops.

Figure 5:
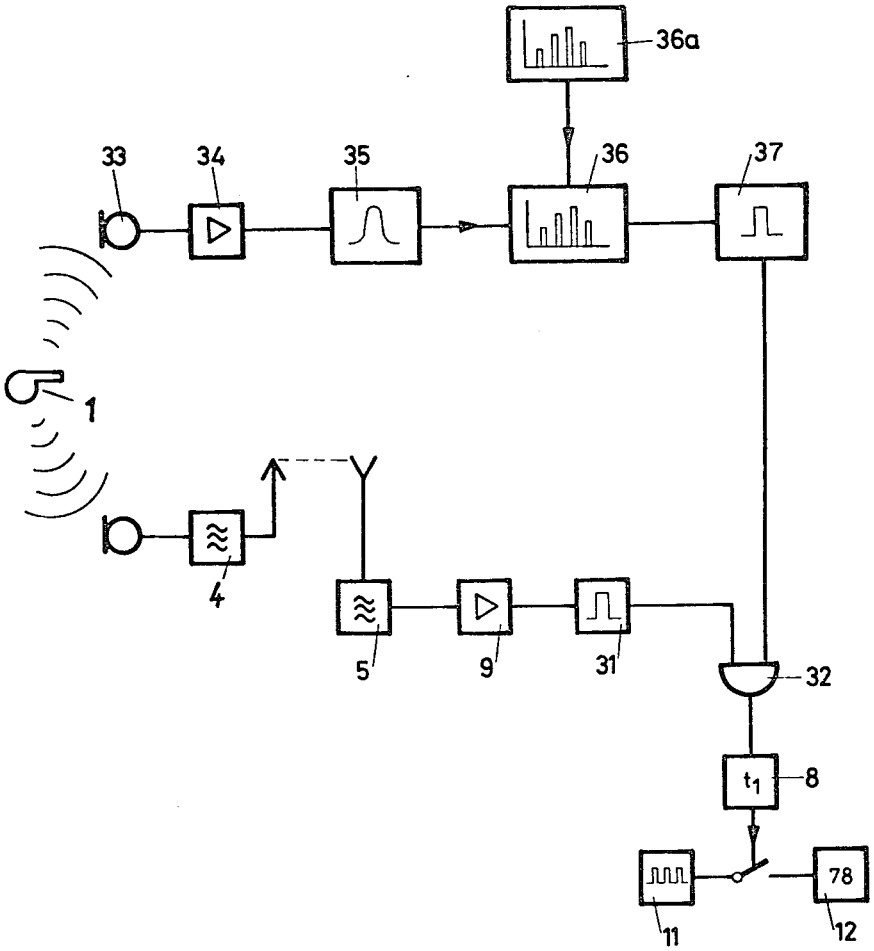
FIG. 5 is a diagrammatic representation of an arrangement with double signal transmission having the features of the invention.

According to FIG. 5 a whistle 1 through a switch device (not shown) influences a transmitter 4 in such a way that every time the whistle 1 is actuated high-frequency signals are emitted which are received by a receiver 5 and fed to an amplifier 9. The amplifier actuates a pulse emitter 31 the output of which lies on one input of an AND member 32.

The sound waves radiated by the whistle 1 are received by a microphone 33, are converted into electrical signals and fed to an amplifier 34. Thus on every actuation of the whistle 1 the referee emits signals by two different media and these are evaluated in the arrangement explained in greater detail below. The acoustically transmitted signals are firstly fed by the amplifier 34 to a band-pass filter 35 in which the characteristic frequencies of the whistle 1 are filtered out selectively and in known manner in one or more stages and all other noises, for example calls by the spectators or whistles with different frequencies are blocked. Thus an extensive elimination of interference is already effected in the band-pass filter 35. From the band-pass filter 35 the resultant signal is then fed to a known spectrum analyser 36 which, as represented diagrammatically at 36*a* compares the previously stored frequency characteristics of the whistle 1 with the arriving signals.

Such spectrum analysers, which as a rule work with small electronic calculators, are known and usual in practice and require no more detailed explanation here. In any case the frequency spectrum delivered by the band-pass filter 35 is analysed in detail and is accepted only in the case of coincidence with the respective intended values. Provided that the received signal was recognised as "correct" in the spectrum analyser 36, actuation of a second pluse emitter 37 takes place, the output of which is connected to the second input of the AND stage 32.

The AND stage 32 lies on the output side on the time member 8, the function of which was described in detail with reference to FIG. 1. It especially examines the time duration of the arriving signal and in dependence thereon connects a clock 12 indicating the remaining playing time, with a timer 11, or interrupts the actuation in the case of interruptions of play.

As may be seen the arrangement according to FIG. 5 is absolutely interference-proof. Even if the receiver 5 is charged with an interference signal by the use of a second transmitter, this in no way leads to influencing of the clock 12 since the AND member 32 permits control signals to pass only if a signal is present simultaneously on both inputs. Even the use of an identical whistle, the frequency spectrum of which cannot be distinguished in the spectrum analyser 36 from that of the whistle 1 of the referee, does not lead to interference with the time measurement, so long as corresponding high-frequency signals are not present at the same time on the receiver 5.

Figure 6:
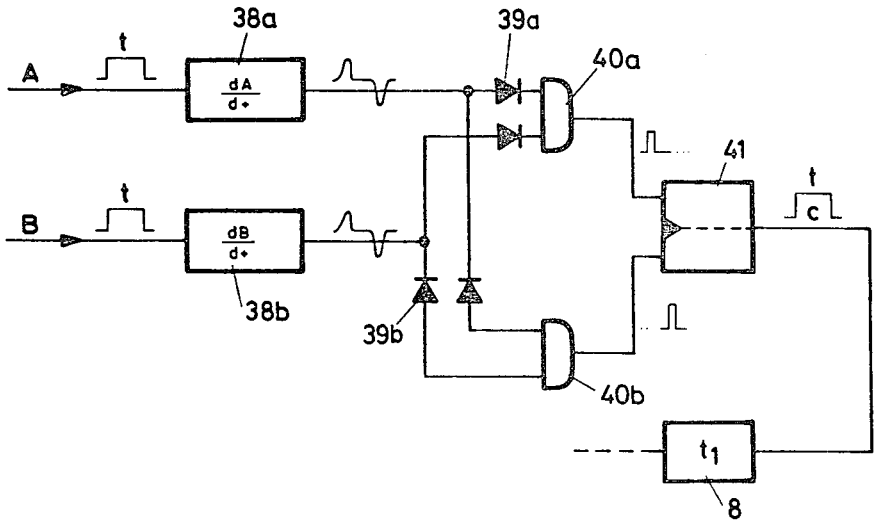
FIG. 6 shows an example of the circuit of an arrangement for blocking interference signals.

FIG. 6 shows an arrangement in which the interference security in the use of two different signals can be improved further. A and B there represent two signals sent by the referee, which can either be transmitted acoustically and electromagnetically by an arrangement according to FIG. 5 or can both be transmitted acoustically or even can both be transmitted electromagnetically.

Instead of wireless transmission from a transmitter to a receiver, the laying of transmitter loops and receiver loops in the playing area and the coupling of the loops by an appropriate arrangement are possible. The use of more than two signals is also possible. If in the arrangement according to FIG. 6 two such signals A and B are each applied to one differentiation member 38*a* and 38*b* this has the effect that only the rising and the falling flanks of the signals are present at the output.

Figure 7:
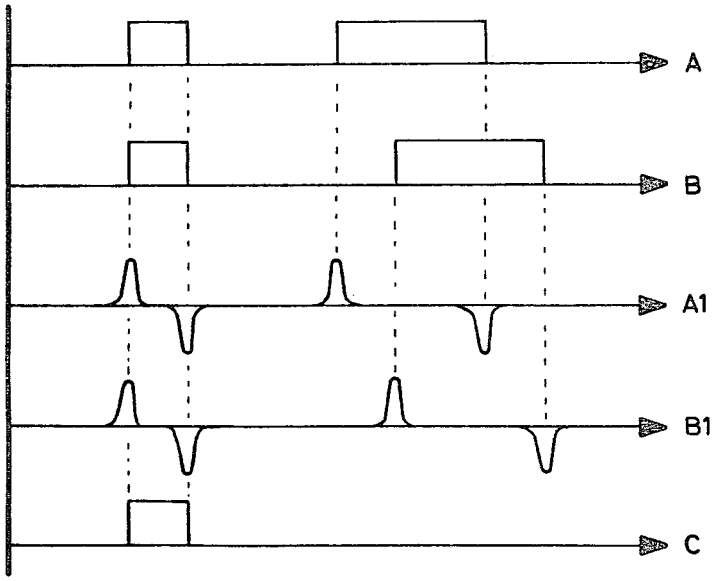
FIG. 7 shows the representation of the signal course at important points in the circuit arrangement according to FIG. 2.

These signals can be fed through the diagrammatically illustrated rectifier arrangements 39*a* and 39*b* to two AND-members 40*a* and 40*b*. Only coincidence of the two positive pulses is compared at the AND member 40*a*, while the two negative pulses are present on the AND member 40*b* and are tested for coincidence. On the output side the AND members 40*a* and 40*b* are connected to the two inputs of a bistable multi-vibrator 41 which is connected on the output side to the time member 8 according to FIG. 5. If with this circuit arrangement, in the course of the signal transmission, the two signals A and B are actuated simultaneously by the referee, this leads to the simultaneous occurrence of two positive pulses ($A_1$ and $B_1$ according to FIG. 7) on the inputs of the AND-member 40*a* so that the bistable multi-vibrator 41 is actuated and the pulse C (FIG. 7) commences. On termination of the signal emission by the referee the pulses A and B drop off, whereby simultaneously pulses $A_1$ and $B_1$ are present on the AND member 40*b*, which leads to the switching over of the bistable multi-vibrator 41. Thus it is ensured that even in the case of the occurrence of an interference pulse at the input A and of a second interferene pulse at the input B, the time-measuring device cannot be disturbed, as long as there is not absolute coincidence of the two signals. As may be seen from the illustration on the right in FIG. 7 a time shift of two signals A and B leads to the occurrence of the differentiated pulses $A_1$ and $B_1$ with time difference, and thus to the fact that they are no longer present simultaneously on the AND members 40*a* and 40*b*. Thus the interference signals remain ineffective without influence upon the time member $t_1$. In practice still further coding and ciphering possibilities exist, without departing from the scope of the invention. Of course it is also readily possible to take into account delays in the signal transmission which occur especialy when transmission takes place through different media (for example acoustic transmission and high-frequency transmission) with different transit times.

We claim:

1. An arrangement for determining the effective playing time of a sporting team game, which has a referee and a predetermined playing duration and in which interruptions of play are signalled by the referee by means of a whistle, comprising at least one time measurement device comprising an actuator input for interrupting and re-starting the measurement; a wireless signal receiver of which the output is connected to the actuator input; a portable transmitter for transmitting signals to the receiver; and a switch device actuatable by the referee to activate the transmitter and to transmit signals to interrupt and re-start the time measurement at the beginning and end of each interruption of play, said receiver comprising at least one playing area reception conductor within the playing area for the reception of signals radiated by the transmitter, at least one interference signal reception device located and arranged to receive signals originating from outside the playing area for the preferential reception of interference signals, and comparator means having inputs connected with said playing area reception conductor and said interference signal reception device for identifying and suppressing interference signals received from the playing area reception conductor without adversely affecting the function of said playing area signals in interrupting and restarting time measurement.

2. An arrangement as defined in claim 1, wherein said interference signal reception device comprises at least one reception conductor laid around the playing area.

3. An arrangement as defined in claim 1, wherein said interference signal reception device comprises at least one reception conductor laid around the spectator positions.

4. An arrangement as defined in claim 1, wherein a plurality of reception conductors arranged in the playing area are connected on the output side through at least one amplifier device to said comparator means, said interference signal reception device being also connected to said comparator means through at least one amplifier device.

5. An arrangement as defined in claim 1, wherein a plurality of reception conductors are formed as reception loops tuned to the transmission frequency.

6. An arrangement as defined in claim 5, wherein at least two concentrically arranged loops are provided in the playing area.

7. An arrangement as defined in claim 1, comprising amplifiers connected to said reception and interference circuits, rectifier arrangements connected between said amplifiers and said comparator means, the rectifier arrangements for the amplifier device of said playing area reception circuits having converse polarity to that of the rectifier arrangement for the amplifiers of said interference signal reception device, whereby the interference signals of the interference signal reception conductor are negative feedback coupled to the proportion of interference signal in the playing area reception conductor.

8. An arrangement as defined in claim 1, comprising transmission conductors in the playing area for the radiation of transmission signals, and a portable reception device for the referee which is tuned to the frequency of the said transmission signals.

9. A method for determining the effective playing time of a sporting team game, in which playing area signals emitted by a referee and interference signals emitted outside the playing area are both received by means of at least two mutually separate reception devices, said playing area signals and said interference signals are compared with one another, and the signals received from the playing area are used to interrupt and re-start the time measurement, and those signals corresponding to the separately received interference signals are identified and filtered out as interference signals.

10. An arrangement for determining the effective playing time of a sporting team game, which has a referee and a predetermined playing duration and in which interruptions of play are signalled by the referee by means of a whistle, comprising at least one time measurement device comprising an actuator input for interrupting and re-starting the measurement; a wireless signal receiver of which the output is connected to the actuator input; a portable transmitter for transmitting signals to the receiver; and a switch device actuatable by the referee to activate the transmitter and to transmit signals to interrupt and re-start the time measurement at the beginning and end of each interruption of play, said receiver comprising at least one playing area reception conductor within the playing area for the reception of signals radiated by the transmitter, and wherein said portable transmitter device for wireless signal transmission emits at least two different signals and the receiver device includes at least one comparator arrangement for ascertaining a variation of such signals.

11. An arrangement as defined in claim 10, wherein said portable transmitter device comprises at least one transmitter for acoustic signal transmission and a transmitter for electromagnetic signal transmission, said receiver device comprises at least one receiver for electromagnetic waves and a receiver for acoustic waves, each tuned to the frequency of the associated transmitter device, and said two receiver devices are connected to a comparator arrangement for monitoring the occurrence of the electromagnetic and the acoustic signals in specific time relationship to one another.

12. An arrangement as defined in claim 10, comprising in the receiver device at least one device for converting variations of at least one of the two signals into control pulses said control pulses being applied to the input of a comparator device so that the time-measurement device is activated only in the case of presence, or only in the case of absence of control pulses.

* * * * *